United States Patent [19]

Ledman et al.

[11] 4,194,629

[45] Mar. 25, 1980

[54] LOVE BOX

[76] Inventors: Dale A. Ledman, c/o George Spector, 3615 Woolworth Bldg., 233 Broadway; George Spector, 3615 Woolworth Bldg., 233 Broadway, both of New York, N.Y. 10007

[21] Appl. No.: 887,860

[22] Filed: Mar. 17, 1978

[51] Int. Cl.[2] ..... B65D 73/00

[52] U.S. Cl. ..... 206/573; 40/313

[58] Field of Search ..... 40/312, 313, 539, 542, 40/459, 475, 448, 491, 508, 573; 206/459, 45.13, 573

[56] References Cited

U.S. PATENT DOCUMENTS

| | | | |
|---|---|---|---|
| 1,414,682 | 5/1922 | Zautner | 40/313 |
| 1,450,477 | 4/1923 | Allworth | 206/45.13 |
| 1,568,982 | 1/1926 | Lengsfield | 40/312 |
| 2,595,973 | 5/1952 | Neugass | 40/542 |
| 2,622,955 | 12/1952 | Kramer | 206/45.13 |
| 2,657,793 | 11/1953 | Goldshine | 206/45.13 |
| 2,675,911 | 4/1954 | Thurston | 206/45.13 |
| 2,684,757 | 7/1954 | McCarthy | 206/45.13 |
| 3,418,740 | 12/1968 | Gray | 40/313 |
| 3,822,781 | 6/1974 | Braginetz | 206/45.14 |

FOREIGN PATENT DOCUMENTS

| | | | |
|---|---|---|---|
| 14332 | of 1899 | United Kingdom | 40/313 |
| 1005574 | 9/1965 | United Kingdom | 40/312 |

*Primary Examiner*—Herbert F. Ross

[57] ABSTRACT

A box for use as a token between lovers for assuring their love to each other; the box including an instruction sheet that states the box is filled with love, and no matter how often it is opened, it can never be emptied; and to get a little love, the box should be opened for a short time, while to receive all the person's love it should be left open all the time; the box including a case and a removable cover.

1 Claim, 5 Drawing Figures

LOVE BOX

This invention relates generally to tokens of love.

A principal object of the present invention is to provide a box for being presented to a person's lover so to be continually reminded of the person's constancy of regard, esteem and love.

Another object is to provide a love box which while containing no physical item, is understood to be filled with etheral love, so that it is always full, and can never be emptied.

Yet another object is to provide a love box which in a modified design thereof includes a means whereby rays of light are constantly within the box that spell out the word love, so that the box can be said to be always filled therewith.

Yet another object is to provide a love box which includes an instructions sheet for commuting either a letter or a full amount of love.

Yet a further object is to provide a love box which can be given either to a sweetheart, a mother, father, brother, sister or any one else that is dear to a person.

Object objects are to provide a love box which is simple in design, inexpensive to manufacture, rugged in construction, easy to use and efficient in operation.

These and other objects will be readily evident upon a study of the following specifications and the accompanying drawing wherein.

Figure 1:
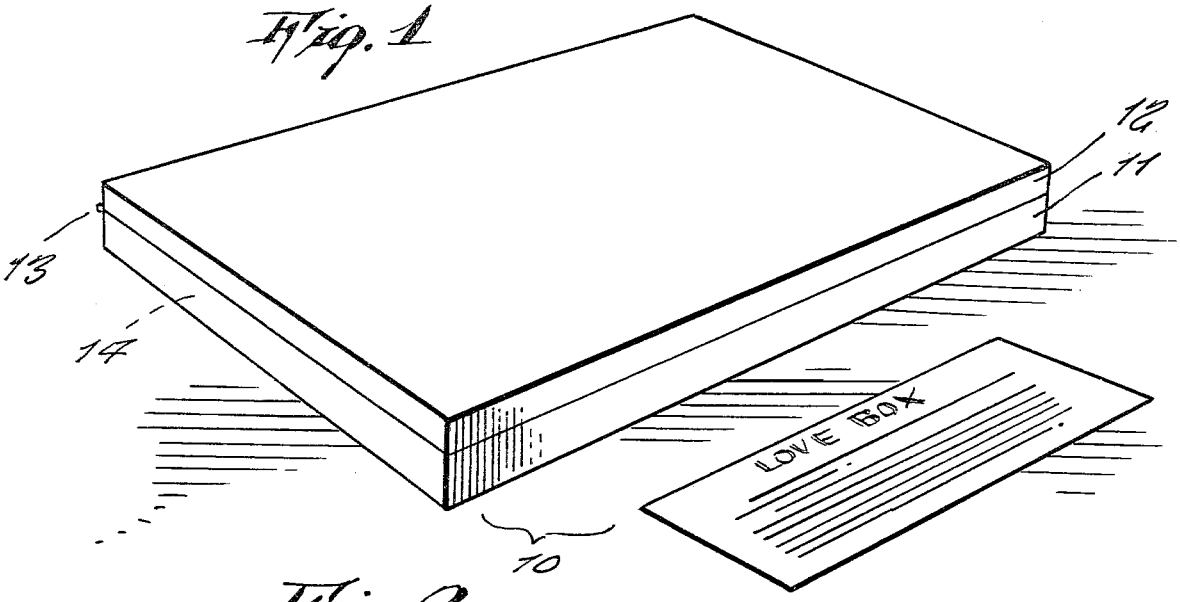
FIG. 1 is a perspective view of the invention showing the Love Box and instruction sheet.
Figure 2:
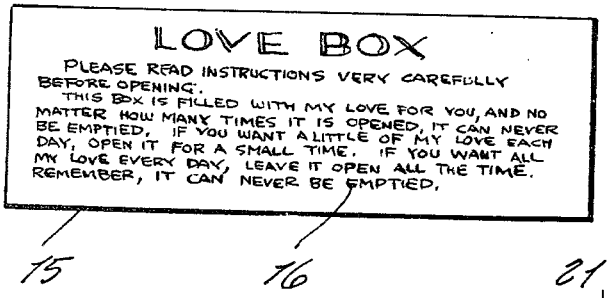
FIG. 2 illustrates the text on the instructions sheet.

Refering now to the drawing in greater detail, and more particularly to FIGS. 1 and 2 thereof at this time, the reference numeral 10 represents a long box according to the present invention wherein there is a case 11 and a cover 12 that is upwardly liftable by means of a hinge 13. The interior 14 of the box contains no physical object, but is understood to be filled with an etheral or spiritual love.

The box may be made to measure a total of 1½ inches high by 6 inches wide and 9 inches long.

A separate card or sheet 15 comprises an exterior component of the present invention; the sheet having printed text 16 thereupon giving instructions to a recipient of the box.

Figure 3:
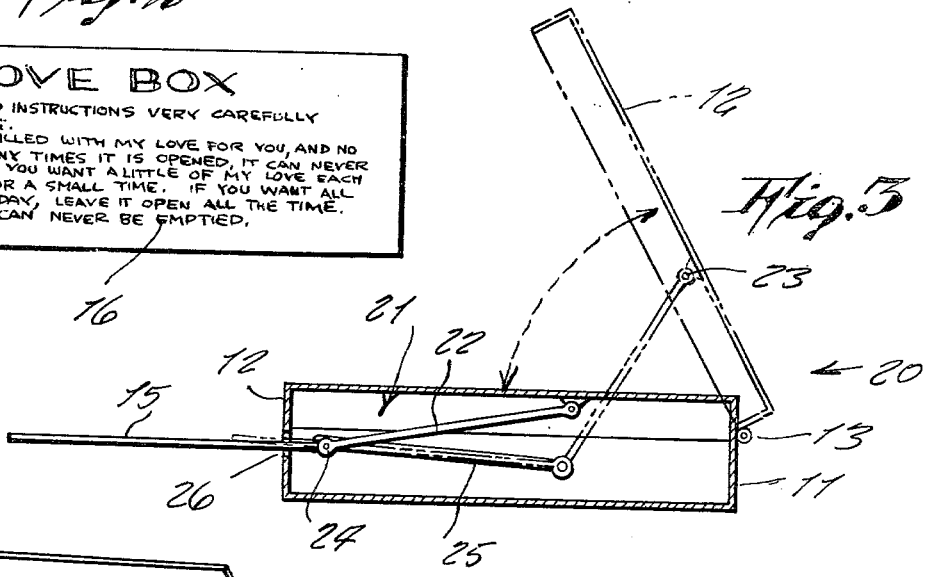
FIG. 3 illustrates a modified construction of the Love Box in which instructions sheet slides out of the box automatically when the box is closed so to be read before opening the box; after the box is opened, the sheet slides inside.

In FIG. 3, another design of the love box 20 includes additionally a linkage mechanism 21 so to automatically slide the card inside the box when the box is opened, and which slides the card outwardly when the box is closed. The mechanism includes a bar 22 pivotally attached at one end to the cover by means of a pin 23, which the opposite end of the bar is pivotally attached by means of a pin 24 to a rear end of the sheet 15; the pin 24 additionally being confined to travel in a slot 25 in a side wall of the case 11. The sheet slides inwardly or outwardly of the box through a slot 26 in a front wall of the case. Thus in use, when the box is closed, the sheet extends outward as shown by solid lines, and when the box is opened, the sheet retracts inwardly.

Figure 4:
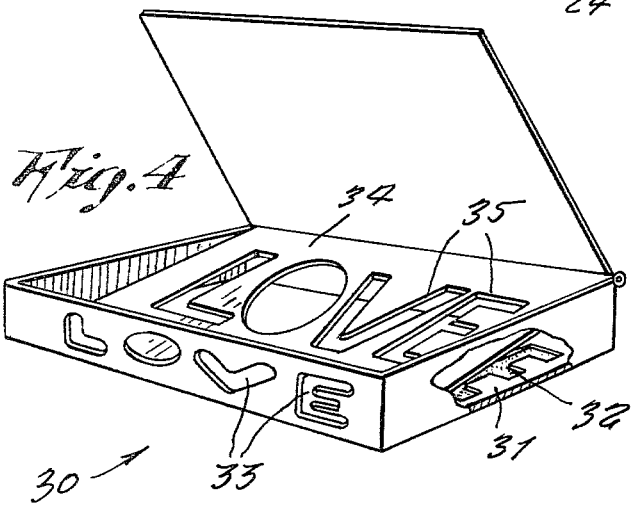
FIG. 4 and FIG. 5 illustrates still another design in which whether the box is opened or closed, in a night or day, light rays either from a seen or from a fluorescent word "love" printed inside the bottom of the box fill the box enterior, the light rays glowing the word "love" so that love thus always fills the box.
Figure 5:
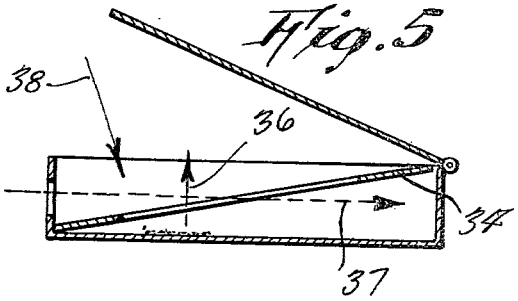

In FIGS. 4 and 5, another design of the love box 30 is shown having the word "Love" printed therewithin on the bottom wall 31, the printing being made flourescent paint so that at all times it radiates light rays in the design of the word. Such light rays fill the box when the box is closed, and additionally radiate outwardly thereof when the box is opened. Such rays of course, are not visible to a naked eye but it is scientifically known that they exist in view of the light radiation from the phosphorescent material 32 in a darkness of night or even in a daylight. Their magnitude cannot be discerned.

Additionally the box 30 includes a means for light rays from a daylight entering the box so to form the word "Love" inside the box. This is accomplished by cut out letters 33 on a front of the box. The box is of course of opaque material.

Additionally an angular opaque panel 34 in the box divides the box into two triangular compartments. Cut out letters 35 in the panel form the word "Love", so that light rays moving therethrough either from the phosphorescent lettering 32, the cut out letters 35 or simply from the box opening, when opened produces light rays forming the word "Love" in both the compartments, as indicated by arrows 36, 37 and 38 in FIG. 5.

While various changes may be made in the detail construction, it is understood that such changes will be within the spirit and scope of the present invention as in defined by appended claims.

What is claimed is:

1. A box for displaying a love message when closed or open, comprising a case having a bottom with an encompassing wall in combination with a cover pivoted at one end to said wall whereby said cover may be moved from a closed position abutting said wall to an open position providing access to said case, in combination with a love message and associated means for displaying said message in both closed and open positions, wherein said means comprise a flourescent substance deposited on the case bottom and including a card mounted in said case spaced from said material, said card having cut-out portions in the form of said message for display when the box is open and further cut-outs through said wall in the form of said message.

* * * * *